United States Patent [19]

Kane

[11] Patent Number: 4,530,177

[45] Date of Patent: Jul. 23, 1985

[54] SIGN WITH INTERCHANGEABLE CHARACTERS

[75] Inventor: Michael Kane, River Forest, Ill.

[73] Assignee: Kane Graphical Corporation, Chicago, Ill.

[21] Appl. No.: 648,452

[22] Filed: Sep. 6, 1984

Related U.S. Application Data

[63] Continuation of Ser. No. 420,044, Sep. 20, 1982, abandoned.

[51] Int. Cl.[3] ..... G09F 7/04

[52] U.S. Cl. ..... 40/621; 40/158 R; 40/489

[58] Field of Search ..... 40/621, 618, 158 R, 40/489

[56] References Cited

U.S. PATENT DOCUMENTS

| | | | |
|---|---|---|---|
| 680,720 | 8/1901 | Lande | 40/618 |
| 1,159,465 | 11/1915 | Brandenburg | 40/618 |
| 1,936,634 | 11/1933 | Lorraine | 40/618 |
| 2,156,775 | 5/1939 | Zimmer | 40/618 |
| 3,126,645 | 3/1964 | Lloyd | 40/621 |
| 3,168,787 | 2/1965 | Surrey | 40/621 |

FOREIGN PATENT DOCUMENTS

| | | | |
|---|---|---|---|
| 2847590 | 5/1980 | Fed. Rep. of Germany | 40/621 |
| 441978 | 1/1968 | Switzerland | 40/621 |

*Primary Examiner*—Gene Mancene
*Assistant Examiner*—Wenceslao J. Contreras
*Attorney, Agent, or Firm*—Russell E. Hattis

[57] ABSTRACT

A changeable sign comprises a support wall for changeable sign components having removably attached thereto a plurality of thin, flat, rectangular, flexible sign component pieces arranged in close contiguous rows so as to fill an entire sign-forming area of the sign and so that the sign component pieces from a distance appear to form a single sheet sign having one continuous flat surface. The sign component pieces are of two basic types, one type being indicia-containing sign component pieces having visible from the front faces thereof one or more numeric digits, symbols, and/or alphabet character indicia so as to form alone or with other adjacent sign component piece, numbers, words, and/or the like, and the other type being blank spacer component pieces which fit between adjacent indicia-containing sign component pieces. There are spacer component pieces between adjacent rows of the indicia-forming pieces which are horizontally elongated strips extending the full width of the sign and spacer component pieces between indicia-containing pieces in each row of the same which are narrow pieces.

16 Claims, 22 Drawing Figures

Fig 5

7

Current Investment Offerings

InterFirst

InterFirst Bank
Greenspoint

9a
B1
9b
B2
9c
B3
9d
B4
B3
9c
9e 11c 11d 11e 11d 11f 11c'

| | Thru | Annual Rate | Annual Yield |
|---|---|---|---|
| All Savers Certificate $500 minimum | 11a Jan 1st 10b | 11.000% | 11.000% 11c' |
| NOW Account $2000 minimum | 11b Jan 1st | 11.000% | 11.000% |
| IRA Valuable Rate $500 minimum | 6A | 6A | |
| 6-month Money Market Certificate $10,000 minimum | | | |
| Regular Savings $200 minimum | | | |
| 91-day Certificate $7,500 minimum | | | |
| 2½-year Certificate $500 minimum | May 1st | 11.000% | 11.000% |

6B

Member FDIC

Fig 7
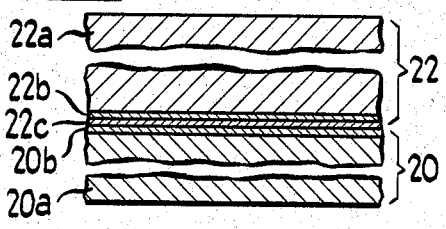
Fig 8
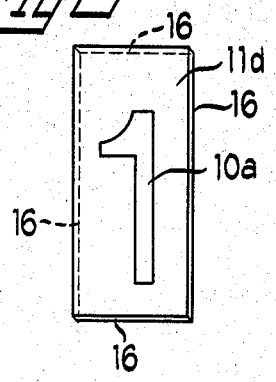
Fig 9
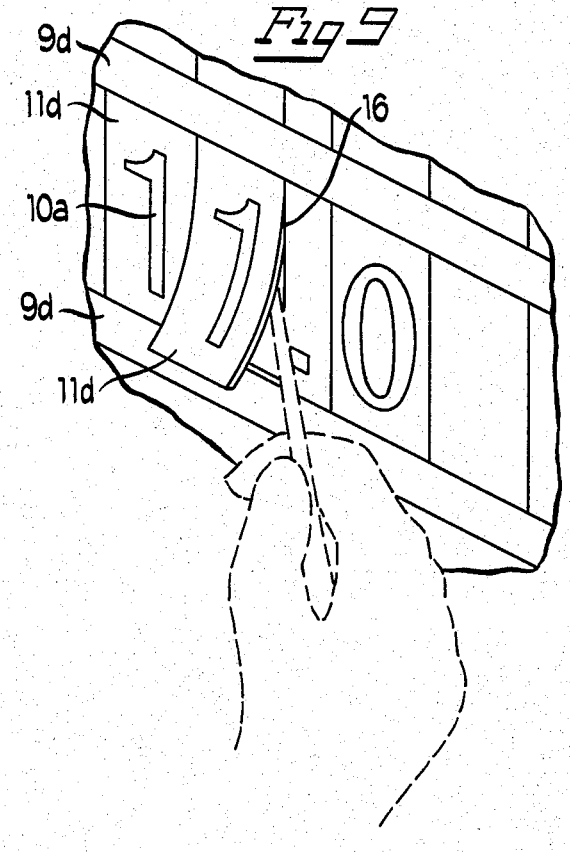
Fig 10
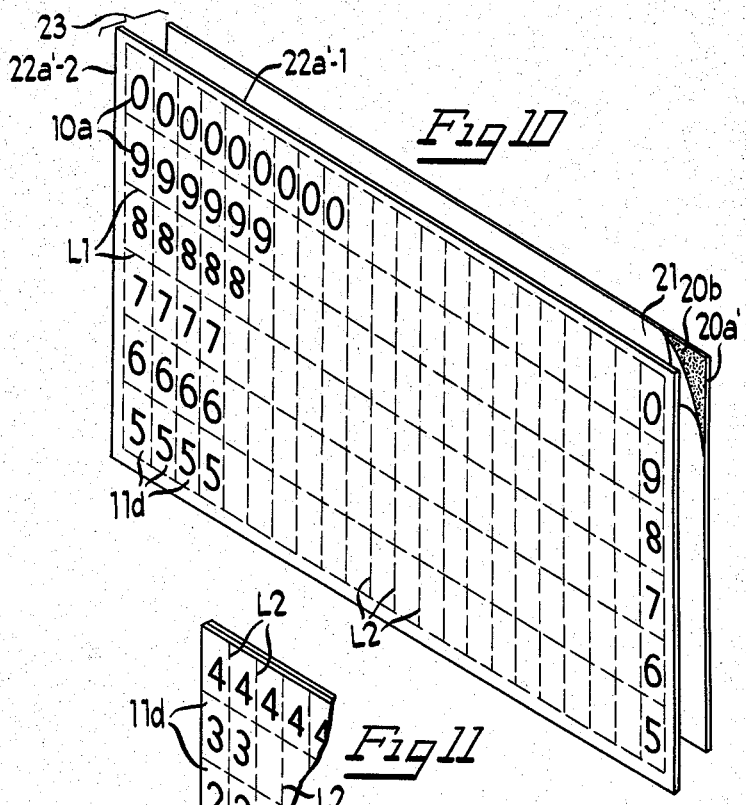
Fig 11
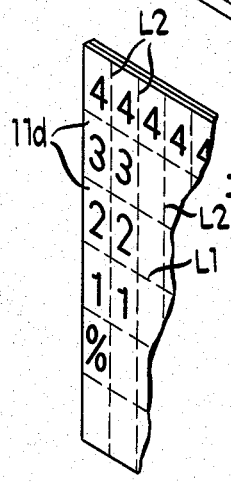
Fig 14
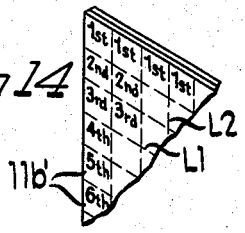
Fig 13
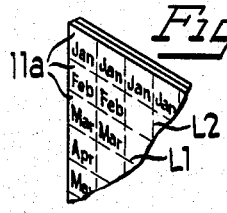
Fig 15
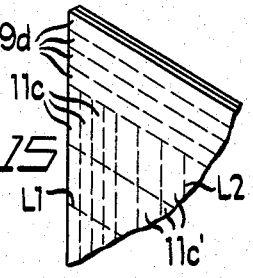
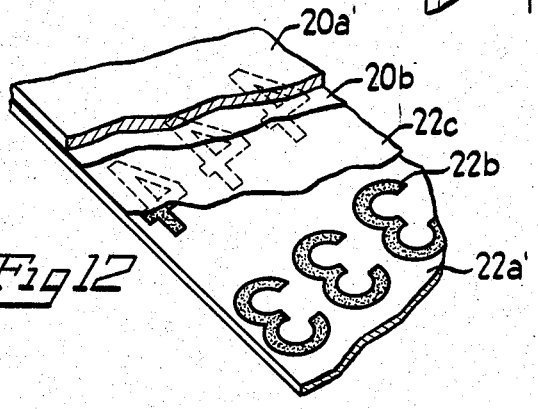
Fig 12

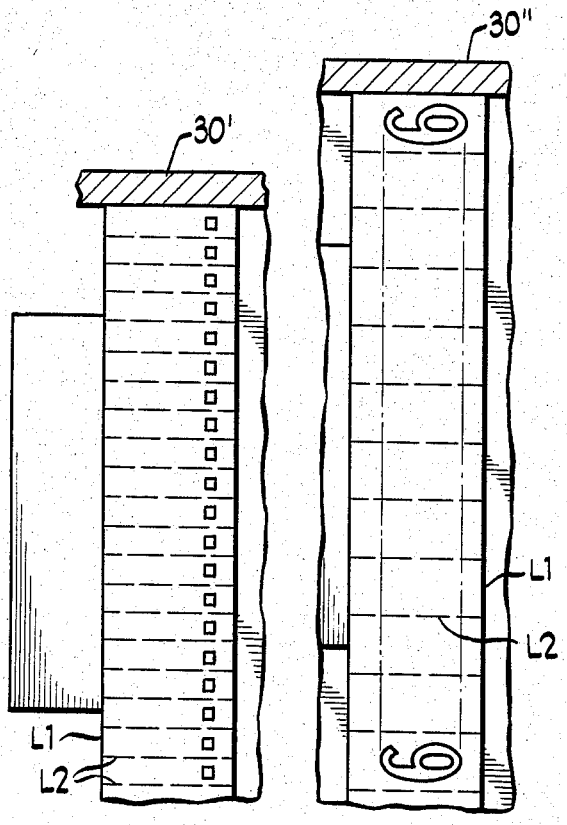
Fig 19
Fig 16
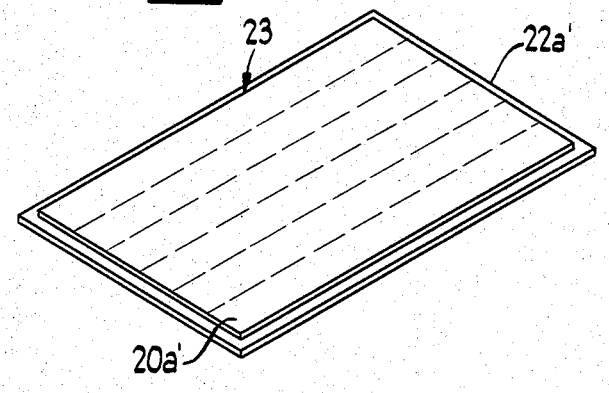
Fig 17
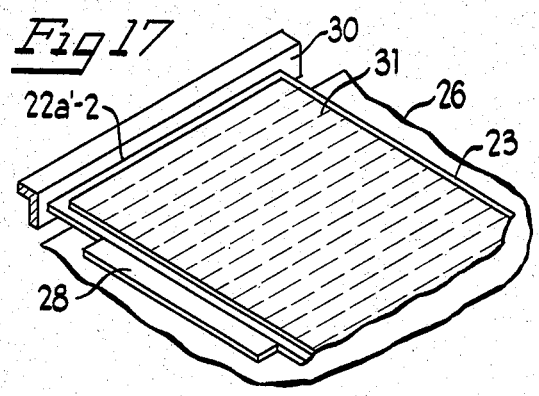
Fig 21
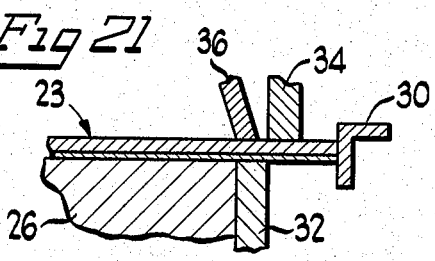
Fig 18
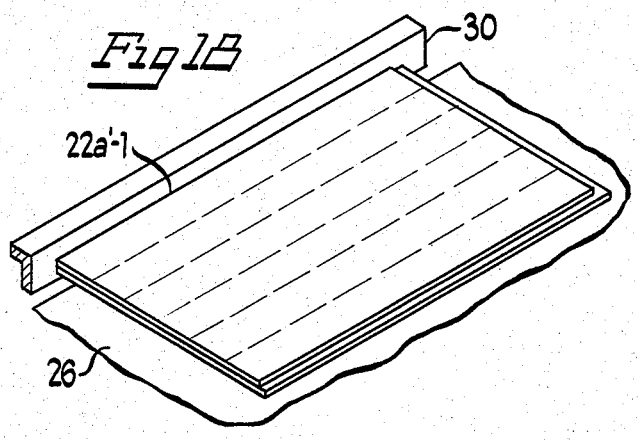

SIGN WITH INTERCHANGEABLE CHARACTERS

RELATED APPLICATION

This application is a continuation of U.S. application Ser. No. 420,044, filed Sept. 20, 1982, entitled CHANGEABLE DISPLAY SIGN and now abandoned.

TECHNICAL FIELD OF INVENTION

This invention relates to changeable signs, such as signs which are used in banks for identifying to the clients of the bank various current investment offerings, and the annual interest rates and annual effective yields provided thereby. However, the broader aspects of the invention apply to other types of changeable signs.

PRIOR ART

Perhaps the changeable sign coming closest to the present invention to be described is one which utilizes a recent development of the B. F. Goodrich Company which has developed a flexible magnetic sheet material which can be directly printed upon, or which sometimes carries a pressure sensitive adhesive coating to which a cover sheet is secured printed on the outside thereof with indicia forming a sign. These sign-forming magnetic sheet materials have sometimes been attached to the metal sides of truck bodies.

Bank interest signs have also been formed from these magnetic sheet materials into individual sign component pieces each forming a numeric digit attached to a metal support surface adjacent to other similarly attached numeric pieces to form an interest rate number. However, these bank interest signs left much to be desired from the standpoint of sign attractiveness and flexibility. Thus, in the different portions of these signs the sign component pieces forming the same projected from the general plane of the rest of the sign. Also, because the edges of the individual sign components pieces projecting from the sign were readily visible and accessible, it was not uncommon for unwanted visitors to the bank to grasp the exposed edges of the sign component pieces and rearrange them to the great consternation of the owners of the bank and their regular customers.

This magnetic sheet material made by the B. F. Goodrich company comes in a standard dark brown color. If the user desired a different background color, he either applied the desired background color upon the face of the magnetic sheet material and then overprinted indicia characters of a contrasting color thereon, or he applied a cover layer over the magnetic sheet material and applied the background color and contrasting indicia over the front face of the cover layer. Such a sign was unattractive to the observer since the different levels of ink thicknesses were visible on the front face of the sign. Also, unruly visitors to the bank sometimes scratched off portions of the printed front face of the sign.

Another disadvantage of the signs heretofore made from the magnetic sheet material is that surface imperfections commonly found thereon, like small depressions or undulations thereof, were visible on the front face of the sign whether or not a printed cover layer was applied thereto. Where a cover layer was applied to the magnetic sheet material, it was so thin that the cover layer followed the surface imperfections of the magnetic sheet material and so did not mask the same.

As will appear, the features of the present invention overcome the disadvantages of the changeable signs just described, and provide a completely unique changeable sign so that the sign when viewed at normal viewing distance therefrom appears to be an unchangeable sign printed on a single sheet of material, presenting one continuous front surface, without the imperfections of the prior art changeable signs just described.

SUMMARY OF THE INVENTION

In accordance with one of the features of the present invention, the changeable sign preferably comprises a magnet attracting support wall encompassing the area of the desired sign and having on either one or both sides thereof an initially exposed sign component-receiving surface to which individual sign component pieces can be secured by magnetic attraction. The entire exposed area of this magnetic attracting wall surface which is to contain sign-forming indicia is covered with thin, flexible sign component pieces preferably having a backing made of said thin, flexible magnetic material, some of which pieces supply only blank (i.e. preferably background supplying) spaces to the sign and others of which supply numeric or alphabet characters and the immediate background thereof. When all of the sign component pieces have been applied to the sign-forming support surface, the entire sign viewed from a short distance therefrom appears as a single sheet of material having one continuous printed front surface, even though, in reality, the front surface is made up of different types of individual sign component pieces to be described. The framing of the sign preferably covers the exposed edges of the outermost sign component pieces of the design.

Since the confronting edges of the various sign component pieces described are in immediate contiguous relationship, it does not appear even to one viewing the sign closely, where the margins of the individual sign component pieces are barely visible, that they can be removed from the sign at any point where desired. However, the thin, flexible sign component pieces of the invention are individually removable, as by use of a thin blade removal tool, which can be readily wedged between adjacent sign component pieces. To enable this tool to readily peel a corner portion of a sign component piece from the support wall surface, in accordance with another feature of the invention at least one and preferably two of the marginal edges of each piece are undercut, as by beveling the same, so that the tool can be readily positioned behind the front face of the sign component piece where it can be pulled forwardly to flex the edge portion of the piece, where the user of the sign can then grasp the flexed portion of the sign component piece and release the piece from the support surface.

In accordance with another feature of the invention, in a bank interest sign the sign preferably includes row and column header strip pieces having complete word-forming indicia identifying the nature of the sign information contained in various horizontal information bands and vertical column portions thereof. There may also be provided a main header strip piece to be placed at the top of the sign to identify the institution involved and the type of information contained on the sign. These header strip pieces contain information which are changed, if at all, only occasionally.

Another type of sign component piece utilized in the bank sign embodiment of the invention is a relatively narrow piece which contains a numeric digit, decimal point, percent sign, or the like, which is changed or repositioned frequently. The decimal point piece is the narrowest piece, and the numeric and percent sign pieces are wider and preferably of identical size. Many such pieces are supplied each user for frequent change of interest rate information in the various information bands of the sign. These sign component pieces and associated row header strip pieces preferably extend the identical full height of a standard sized information band of the sign. There is also provided narrow blank spacer sign component pieces of at least two different widths to give a choice of indicia separation distances. Blank spacer strips extending the full length of an information band are also preferably provided to separate successive information bands of the sign.

Another type of changeable sign component piece preferably provided are relatively narrow and short sign component pieces containing month and day indicia to identify the term of a the particular interest rate involved. Such pieces may, for example, be half the height of an information band of the sign and be positioned one above the other so as together occupy the height of a single information band of the sign.

In accordance with another feature of the invention, to give the sign the attractive appearance of a printed one sheet sign, the background color of all of the sign component pieces described is made identical. The background color is preferably a dark color which best masks the juncture line of the pieces.

In order for the sign of the kind described to be most easily assembled, and to provide a sign of maximum attractiveness, it is highly desirable that all of the numeric information contained in the various bands of the sign line up perfectly in a vertical direction. When an information band of the sign consists of a large number of individual sign component pieces, it can be readily appreciated that unless the corresponding numeric, decimal point, percent sign, etc. pieces have substantially identical widths, it will be difficult to get the desired precise vertical alignment thereof in the various information bands of the sign since dimensional errors are cumulative. It is believed that no one has heretofore considered making a sign of the type described where such perfect vertical alignment is achieved since it is not an easy matter to make the individual sign component pieces to precisely the same size (i.e. to tolerances of ±0.005"). One of the aspects of the invention which makes this precise vertical alignment possible involves the method utilized to form and cut the various sign component pieces above described. This unique method will be described in the specification to follow.

In accordance with still another feature of the present invention, each of the sign component pieces described comprises a flexible translucent cover layer laminated over a flexible magnetic backing layer. In the most preferred form of the invention, each of the sign component pieces has a translucent cover layer of such thickness that any imperfections in the surface of the magnetic backing layer will not be transferred to the front face of the cover layer thereof. A 0.010" thick polycarbonate cover layer provides this advantage. Before the cover layer is laminated to the backing layer, the inner face thereof is photo silk screened printed with ink to form the desired numeric, alphabet, or other indicia and then the appropriate background color is silk screen printed. Thus, the printed indicia is not exposed to the outside of the sign where it can be worn away or damaged. Other advantages and features of the invention will become apparent upon making reference to the specification and claims to follow.

DESCRIPTION OF DRAWINGS

FIG. 5 is a front elevational view of the sign component piece support wall and the sign component pieces supported thereon for the sign shown in FIG. 1, with the frame portions of the sign removed from the figure;

FIG. 7 is a fragmentary very greatly enlarged sectional view through one of the sign component pieces referred to showing the different layers making up each sign component piece, and the coatings applied to these layers;

FIG. 8 is a view of one of the sign component pieces;

FIG. 9 is a fragmentary perspective view of a portion of the bank interest sign of FIG. 1 as the sign component piece is being removed therefrom;

FIG. 10 is an exploded view a numeral letter form sheet and a sheet of pressure sensitive-coated magnetized material with a pull-off cover sheet over the adhesive thereof, which sheets are laminated together to form a letter form matrix to be cut into smaller sign component pieces to be used with the sign of the present invention;

FIG. 11 is a fragmentary perspective view of a trimmed letter form matrix formed from another letter form sheet laminated to a magnetized backing like that shown in FIG. 10 and from which numeral, percentage sign and decimal point sign component pieces are cut for use in the sign of the present invention;

FIG. 12 is a broken away fragmentary perspective view of a portion of the matrix of FIG. 11 showing the various layers and coatings making up the same;

FIG. 13 is a fragmentary perspective view of a letter form matrix formed from a month letter form sheet laminated to a magnetized backing like that shown in FIG. 10 and from which month-indicating sign component pieces for use in the present invention;

FIG. 14 is a fragmentary view of a letter form matrix formed from a letter form sheet which is laminated to a magnetized backing like that shown in FIG. 10 and from which date-indicating sign component pieces are cut for use in the present invention;

FIG. 15 is a fragmentary perspective view of a matrix formed from a blank, spacer sign component piece-forming sheet laminated to a magnetized backing like that shown in FIG. 10, and from which sheet the various spacer sign component pieces are cut for use in the present invention;

FIG. 16 is a view of any of the matrices of FIGS. 11, 13, 14 and 15 as viewed from the backing sheet side of the matrix and before the same has been trimmed;

FIG. 17 is a perspective view of a sheet support platform of a shearing device, to which one of the sign component-forming magnetic matrices described is placed in making a first trim cut along a side reference edge thereof, the side and top reference edges thereof being positioned respectively against a backstop and a side guide thereshown;

FIG. 18 is a view of the shearing device shown in FIG. 17 where the matrix shown in FIG. 15 has been rotated 90 degrees and placed so that the top reference edge of the matrix is placed against the backstop shown in FIG. 17;

FIG. 19 shows a different shearing device designed for cutting individual numeral, letter, percent sign or spacer pieces from a strip severed from a matrix thereof, there being two sections of the shearing device illustrated to show how pieces of different widths are cut using two different separately adjustable backstops and common shearing blades;

FIG. 21 is a sectional view through the support table of any of the shearing devices shown in FIGS. 17–19 and illustrate the movable and stationary cutting blades, backstop and holddown bar of the shearing devices involved.

DESCRIPTION OF EXEMPLARY EMBODIMENT OF THE INVENTION SHOWN IN THE DRAWINGS

Figure 1:
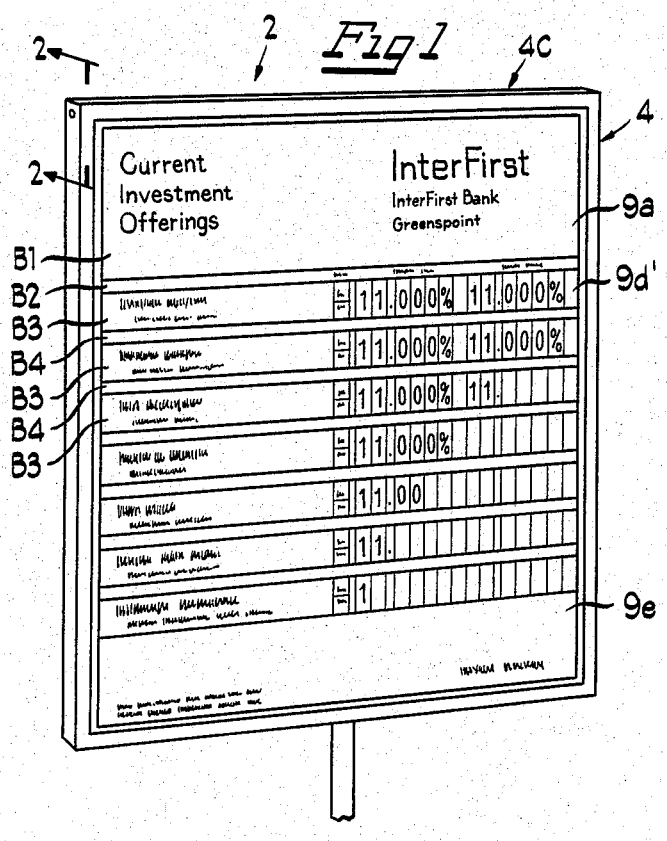
FIG. 1 is a perspective view of a pedestal-type sign constructed in accordance with the present invention.
Figure 2:
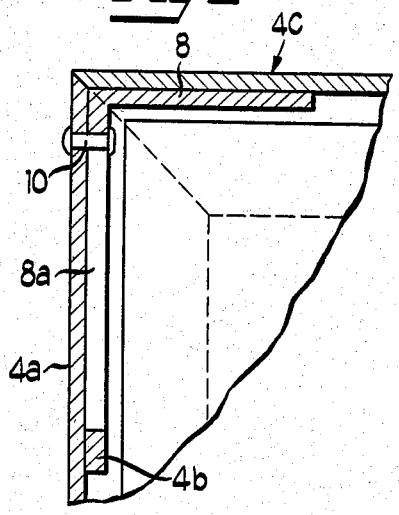
FIG. 2 is a fragmentary vertical sectional view through the upper left hand corner of the sign shown in FIG. 1, taken along section lines 2'2.
Figure 3:
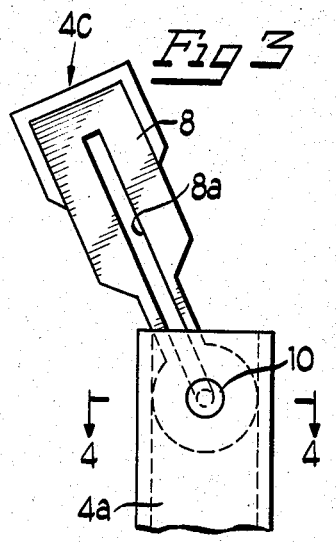
FIG. 3 is a view of the portion of the sign shown in FIG. 2, with the movable upper cover strip of the frame raised and pivoted to expose a slot for receiving a sign component piece support wall having sign components constructed and arranged in accordance with the present invention.
Figure 4:
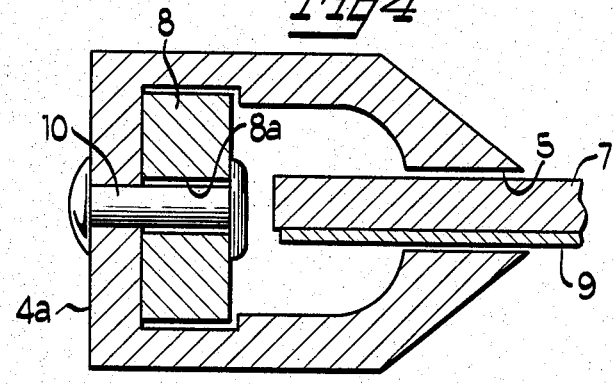
FIG. 4 is an enlarged fragmentary horizontal sectional view through the portion of the sign shown in FIG. 3, taken along section line 4—4 therein.

Referring now to FIG. 1, there is shown a sign 2 for use in a bank or other savings institution for identifying the different types of investment certificates and the annual rates and annual yields applicable through the stated month and date. The sign includes a support frame 4 which can have any desired construction. As illustrated, it has side strips 4*a*—4*a* connected at the bottom thereof by a bottom frame strip 4*b* and at the top by a swingable cover strip 4*c* which is pivotable as shown in FIG. 3 to expose a vertical track or slot 5. The slot 5 slidably receives a vertical metal sign component support wall 7 adapted to carry on one or both faces thereof sign component pieces 9 and 11 formed of narrow pieces or elongated strips to be described, each including a magnetizing backing layer which magnetically adheres the same to the support wall 7. After the support wall 7, is dropped into the slot 5 where it comes to rest upon the bottom frame strip 4*b*, the cover strip 4*c* is pivoted back into place to close off the slot 5. The ends of the strip 4*c* illustrated have secured thereto angle members 8—8 having horizontally extending legs 8*a*—8*a* welded or otherwise secured to the cover strip and depending legs 8*b*—8*b* each having a vertical slot 8*c* therein to receive a pivot and guide pin 10 projecting inwardly from the upper end of the adjacent side frame strip 4*a*. The cover strip 4*c* is thusly slidable and pivotable with respect on the pins 10—10 between a lowered position where the strip 4*c* is contiguous to the upper ends of the side frame strips 4*a*, and an elevated position shown in FIG. 3 which exposes the guide slot 5 as described. The present invention deals primarily with the shapes, constructions, and arrangements of the sign component pieces which form a unique sign having one or two sign-forming face thereof, each of which appears from ordinary viewing distance to have a continuous, flat surface having printed indicia thereon. It should be understood that the sign component pieces 9 and 11 occupy an entire desired sign-forming area on one or both faces of the support wall 7, which area may encompass the entire vertical extent of the face of the support wall involved, as in the illustrated sign, or a partial portion of the height thereof, in which event the bottom portion of the sign-forming portion of the support wall 7 would be closed by a magnetized metal bar or the like, which extends along the bottom margin of the bottommost sign component pieces.

In the case of signs for banks identifying the interest rates for various types of investment certificates, as shown best in FIG. 1, the sign 2 of the invention generally has a main upper information band B1 identifying the subject matter thereof, namely "Current Investment Offerings" of the bank or other institution involved. This area of the sign is formed by a main header strip 9*a* which, like the other sign component pieces, is a thin, flat, rectangular and flexible piece with a magnetized backing adhering the same to the face of the support wall 7. The side and top margins of the strip 9*a* adjacent to a portion of the frame are preferably covered over thereby so that the edges thereof are not exposed.

The sign 2 also has numerous other horizontally extending information bands or areas containing various kinds of information. Thus, immediately below the main information band B1 is a column information band B2, which may contain the words "Thru" as shown in FIG. 5, identifying a month and date column of the sign, and "Annual Rate " and "Annual Yield" indicia identifying the subject matter of the two vertically aligned columns of numbers appearing in various horizontally extending interest rate bands B3. The column information band B2 may be formed from a single horizontally elongated thin, flexible sign component strip 9*b* constructed like the row header strip 9*a* and other sign component pieces to be described hereafter.

The interest rate bands B3 contain at the left hand portion thereof a region extending only a fraction of the full width of the sign and formed from a row header strip 9*c* which identifies the type of investment offering or certificate involved. As best shown in FIG. 5, to the right of row header strip 9*c* is a pair of vertically spaced month and date indicating sign component pieces 11*a* and 11*b*. These sign component pieces 11*a* and 11*b* are shown as being of identical size, each occupying one half of the height of the interest rate band B3 involved. All of the interest rate bands B3 are shown as having identical height to form a sign of maximum attractiveness and neatness.

Immediately contiguous to the right of the month and date sign component pieces 11*a* and 11*b* is a narrow, blank, spacer-forming sign component piece 11*c*. Each interest rate band B3 has an identical sign component piece to the piece 11*c* shown. To minimize the number of different size pieces to be used, it is preferred to have two basic types of narrow spacer sign component pieces, namely the narrowest spacer piece 11*c* just described and one twice the width thereof, namely the spacer sign component piece 11*c*′ shown at the end of the interest rate band B3 in FIG. 5. A similar spacer sign component piece 11c' is placed between the two sets of interest rate information identified previously, in the "Annual Rate" and the "Annual Yield" columns of the sign.

To the right of the narrow spacer sign component piece 11c and the next spacer piece 11c' are a series of numeral and decimal sign component pieces, the numeral pieces being identified by reference numeral 11d and the decimal sign component piece being identified by reference numeral 11e. Finally, each of the interest rate bands B3 of the sign will have a percent sign component piece 11f following each multidigit number in the interest rate and interest yield columns of the sign. Each of the sign component pieces 11a, 11b, 11c, 11c', 11d, 11e and 11f are individually removable from the sign in a manner to be described.

To minimize the cost of fabrication of the sign component pieces and to simplify the manufacture thereof in a manner to be described, all of the row header strips 9c at the beginning of each interest rate band B3 preferably will be of identical width and height and all of the spacer, numeric, decimal point and percentage sign component pieces except the month and data pieces 11a and 11b, preferably will have identical heights. Except for the decimal sign component pieces 11e, which have an identical width to the narrow spacer sign component pieces 11c, the other small sign component pieces, namely the numeric, percentage spacer, month and date sign component pieces 11d, 11e, 11c', 11a and 11b preferably will have identical widths.

In order to provide a sign which has a maximum information band spacing flexibility, it is most advantageous to provide horizontally elongated sign component spacer strips 9d which are only a fraction of the height of the interest rate bands B3 and extend for the full width of the sign face. The strips 9d will generally separate the interest rate information bands B3 formed by the row header strips and the small sign component pieces just described.

At the very bottom of the indicia-carrying portion of the sign, there may be provided a horizontally elongated sign component strip 9e which can be a blank strip or a strip containing additional information which the bank or other financial institution desires to communicate to its customers.

As previously indicated, each of the sign component pieces described has an identical thickness and construction to be described, which enables the pieces to be placed in immediate contiguous relationship to the adjacent sign component piece to the right, left, above or below the same, so that from a few feet away the front surface of the sign appears to be a continuous surface of a printed sheet of material. A sign of this type could not be made as a practical matter unless the pieces could be economically fabricated to precise tolerances and related in a manner such that they can be readily peeled one piece at a time from the surface of the support wall 7. FIG. 9 shows the manner in which an individual sign component piece can be removed from the support wall 7, such as by the use of a thin blade edge tool which is pushed into the space adjacent sign component pieces. Because of the undercut shape of the sides of these pieces, preferably formed by bevelling the edges thereof in a shear cutting operation, the tool can then be twisted to bring the tool blade edge behind the magnetic backing of the piece involved, where a forward pull on the tool flexes the edge portion of the sign component piece forwardly from the support wall.

Referring now more particularly to FIG. 7, each of the sign component pieces comprises a relatively thin magnetic backing layer 20 which includes a main body portion 20a advantageously coated with a pressure senstivie adhesive 20b. The main body portion 20a of the magnetic backing layer 20, which preferably has a consistency of flexible rubber, can be a product like this manufactured by the B. F. Goodrich company as previously indicated. For example, the body portion 20a of the magnetic backing layer 20 may have a thickness of about 0.020".

Each sign component piece also preferably has a cover layer 22 having a main translucent body portion 22a, which may be a 0.010" thick polycarbonate, or other similar material, sold under the name Lexan and manufactured by General Electric Company. The main body portion 22a of the translucent cover layer has photo screened printed on the inner face thereof a first indicia-forming coating 22b on the inner face thereof, and a silk screen printed background colorforming coating 22c thereover. A cover layer of this thickness does not follow the depressions and undulations in the outer surface of the magnetic backing layer 20, as could be the case if the main body portion 22a were a fraction of this thickness.

Figure 6A:
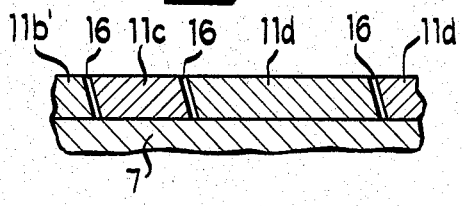
FIG. 6A is a greatly enlarged fragmentary vertical sectional view through the support wall and sign component pieces supported thereon, as seen along section line 6A—6A in FIG. 5.
Figure 6B:
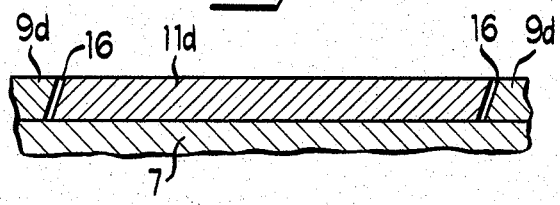
FIG. 6B is a fragmentary horizontal sectional view through the same section of the sign referred to, as seen along section line 6B—6B in FIG. 5.

As previously indicated, of importance to permit the individual sign component pieces to be readily peeled from the support wall 7 is the fact that the confronting surfaces of the adjacent sign component pieces are beveled as shown by the bevelling 16 in FIGS. 6A and 6B. This bevel is automatically formed when conventional shear-type devices commonly used to shear through metal sheets are used to shear through the laminated sheets now to be described, from which the sign component pieces are made.

FIG. 12 shows the rear of a laminated letter from matrix from which the various sign component pieces 9 and 11 described are preferably formed. Each matrix comprises a cover layer sheet 22a' of polycarbonate or the like having the thickness of the main body portion 22a of the front cover layer 22 of each sign component piece to be cut therefrom. The sheet 22a' is laminated to the pressure sensitive coating 20b of a magnetic backing layer sheet 20a', from which is formed the main body portion 20a of the magnetic backing layer 20 of each sign component piece to be cut therefrom.

Figure 20:
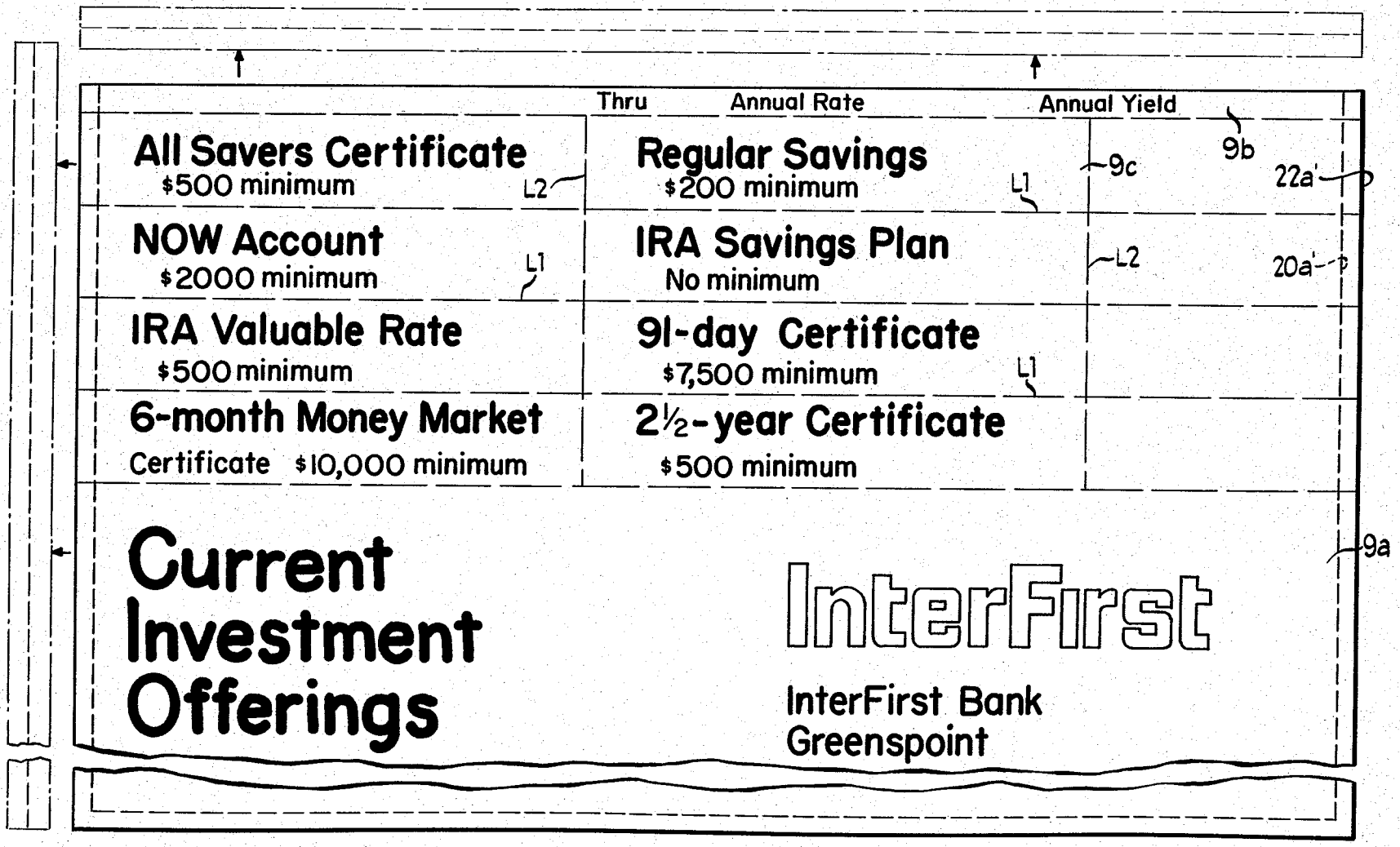
FIG. 20 is a front view of a letter form matrix from which all of the header strips in FIGS. 1 and 5 are formed and after it is trimmed, and shows in dashed lines the various lines along which this matrix is cut to form the various sign component pieces involved.

The cover layer sheet 22a' is made to a precise dimension, with the top marginal edge 22a'-1 and the left marginal edge 22a'-2 as viewed from the front of the sheet being reference edges thereof from which the various indicia printed on the sheet is precisely located so that after a trim cut of, for example, ¾" is made the corresponding top and left margins of the various indicia-containing areas thereof are identically spaced. The magnetic backing layer sheet 20a' is covered by a protective sheet 21 which protects the pressure sensitive adhesive coating 20b. When this protective sheet is removed, a cover layer sheet 22a' is laminated to the coating 20b of the magnetic backing layer sheet 20a' to form a laminated letter form matrix 23. The backing layer sheet 20a' of each matrix is somewhat smaller than the associated cover layer sheet 22a' thereof so that it is located within the margins of the cover layer sheet, as shown best in FIG. 16. The cover layer sheet 22a' of each matrix preferably is made oversized before it is applied to the shearing devices to be described, so that initially the trim cuts are made along cut lines spaced from the reference edges 22a'-1 and 22a'-2 and falling within the margins of the backing layer sheet 20*a'* (see FIG. 20 showing such a trimmed matrix 23). These trimming operations are shown in FIGS. 17 and 18.

The shearing device S1 shown in FIGS. 17 and 18 has a table 26 upon which the laminated matrix 23 is placed, with the cover layer sheet 22*a'* face down upon the table 26 and with an edge thereof against an adjustable backstop 30. The matrix 23 is placed on table 26 so that the cover layer sheet 22*a'* is face down because, otherwise, the magnetized backing layer sheet 20*a'* could not be readily moved into position when the table is made of a magnetic field attracting metal like steel, since then the matrix would be difficult to move into position against the backstop 30. In the first trim cut shown in FIG. 17, the matrix 23 is fed so that the reference side edge 22*a'*-2 abuts against the backstop 30 of the device and so that the reference edge 22*a'*-1 extends along the straight inner edge of a guide strip 28 extending at right angles to the backstop 30. This trim cut, for example, could be a $\frac{3}{4}''$ trim cut. In the second trim cut shown in FIG. 18, the top reference edge 22*a'*-1 is pushed against the backstop 30 and a similar ($\frac{3}{4}''$) trim cut is made. The resulting matrix is shown in FIG. 20 for a cover letter form matrix made for the header strips. The trimmed matrix is then ready for shearing along horizontal or row cut lines L1 and vertical or column cut lines L2 as shown in dashed lines in FIGS. 10, 11, 13, 14, 15 and 20.

After the two trim cuts are made on a letter form matrix, the matrix is then ready for severance first along the various horizontal cut lines L1 which for most of the sign component pieces are spaced an interest rate band width apart (e.g. $1\frac{3}{4}''$) to form strips from the matrix involved. A shearing device like device S1 is provided (not shown) which makes such ($1\frac{3}{4}''$) spaced cuts. A different shearing device (or shearing device section) is provided for each different sign component piece dimension. Once a backstop position of a shearing device is fixed precisely, it can remain in such position. Next, the various strips formed from the matrix are cut transversely along transverse cut lines L2 spaced apart a distance equal to the width of the desired sign component piece involved. For numeral, month, date, percentage and wider spacer sign component pieces, the cut lines L2 are closely spaced (e.g. $\frac{3}{4}''$ apart).

In the case of the decimal point sign component pieces 11*e* and the narrow spacer pieces 11*c*, these are applied to a shearing device precisely adjusted to cut the desired widths, such as $\frac{3}{8}''$. The month and date sign component pieces 11*a* and 11*b* have the same widths of the numeral sign component pieces, such as $\frac{3}{4}''$ but half the height thereof (e.g. $\frac{7}{8}''$).

FIG. 19 illustrates a shearing device S2 having two adjustable backstops 30' and 30'' which are adapted respectively to form cuts along cut lines L2—L2 spaced apart respectively $\frac{3}{8}''$ and $\frac{3}{4}''$ necessary for cutting the decimal, spacer, numeral and percentage sign component pieces in the example of the invention now being described.

FIG. 15 shows the matrix 23 from which spacer pieces are formed and thus contains no indicia, although it has the same background color as in the indicia-carrying sign component pieces. (The preferred background color of all sign component pieces is a dark color like black, contrasting to a light indicia color, like white, because the dark background color blends best with the normally relatively dark lines appearing at the juncture of adjacent sign component pieces because of shade effects or the dark (brown) color of the magnetic backing layer which appear at the sides of these pieces.) The cut lines L1 and L2 formed on this matrix for forming the various spacer pieces of course will follow cut lines required for spacer strips 9*d* extending the full sign width and the narrow $\frac{3}{8}''$ and $\frac{3}{4}''$ spacer pieces 11*c* and 11*c'* previously described.

FIG. 20 shows a trimmed matrix from which all of the header strips previously described and formed by shearing along the various cut lines L1 and L2 thereof.

A customer for a particular sign will receive a kit containing a desired number of sign component pieces comprising spacer and header strips and the smaller blank spacer pieces, and pieces having numbers, decimal points, percentage signs, date and month indicia thereon.

FIG. 21 shows a typical shearing device useable for devices S1 and S2. It includes the table 26, a stationary bottom knife edge 32, an upper movable shearing blade 34 which acts like a scissors blade, and a hollow bar 36. A backstop 30 is supported for adjustment in any well known way for movement in the direction of the arrows 30.

Both the structural and method aspects of the invention described cooperate to produce a unique sign system. Utilizing separate shearing devices or shearing device sections with individual precisely adjustable backstop for the different cutting distances required, precisely dimensioned thin, flexible, bevelled sign component pieces are formed which, when closely interfitted together, form perfectly aligned rows and columns of numbers heading indicia, which give the appearance that the sign has a continuous outer face, while permitting the easy removable of the individual thin flexible sign component pieces from the support wall 7 involved. Also, since the silk screen printing of the background and indicia is on the inner faces of the translucent cover layer of the sign component pieces, the indicia involved is protected from damage and wear.

It should be understood that numerous modifications may be made in the preferred embodiment of the invention just described without deviation from the broader aspects of the invention.

I claim:

1. A changeable sign comprising: a support wall for changeable sign components, said support wall having on at least one side thereof an initially exposed sign component-receiving surface; said sign component-receiving surface having removably attached thereto a plurality of thin, flat, rectangular, flexible sign component pieces arranged in close edge-to-edge confronting relation and in contiguous rows so as to fill an entire sign-forming area of the sign and so that the sign component pieces from a distance appear to form a single sheet sign having one continuous flat surface; said sign component pieces being of two basic types, one type being indicia-containing sign component pieces having visible from the front faces thereof one or more numeric digits, symbols, and/or alphabet character indicia so as to form alone or with other adjacent sign component piece, numbers, words, and/or the like, and the other type including blank spacer component strips which fit between adjacent rows of indicia-containing sign component pieces, said strips extending substantially the full length of said rows, the sign component pieces in each row encompassing the same vertical height to present spaced, parallel horizontal edges at the top and bottom of each row, and said blank spacer strips also presenting spaced, parallel horizontal edges at the top and bottom thereof confronting the edges of other sign component pieces.

2. The changeable sign of claim 23 wherein there are also narrow spacer component pieces between indicia-containing pieces in each row of the same.

3. The changeable sign of claim 1 wherein each of said sign component pieces except said strips have on the top and right side of the piece beveled edges of given inclination and the bottom and left side of the piece having edges oppositely beveled to the edges of said top and right side so that adjacent confronting edges of adjacent component pieces interfit, and the top and bottom edges of said strip have the same beveled edges as the other sign component pieces.

4. The changeable sign of claim 1 wherein at least one marginal edge portion of each sign component piece has an undercut portion so that, if desired, a thin-edged tool can be inserted between adjacent sign component pieces and behind one of the same and then pulled forward to peel the latter piece away from said support wall.

5. The changeable sign of claim 1 wherein said sign component pieces include means for holding the same upon said support wall by magnetic force.

6. The changeable sign of claim 1 wherein the background color of the indicia-containing component pieces and the spacer component pieces are identical.

7. The changeable sign of claim 6 wherein said background color is a dark color and said indicia is a relatively light color.

8. The changeable sign of claim 1, 2, or 6 wherein said sign includes a peripheral frame which covers the outer edges of the outermost of said sign component pieces.

9. The changeable sign of claim 1, 2, 3 or 5 wherein said indicia-containing sign component pieces include horizontally elongated row header strips heading the respective rows of indicia-containing sign component pieces and displaying complete words describing the type of information contained in the row of pieces involved, and there being in each row following each row header strips relatively narrow sign component pieces each having thereon only a single numeral and which can be individually removed and replaced by another numeral sign component piece to modify the number displayed on the row of sign component pieces involved.

10. The changeable sign of claim 1, 2 or 3 wherein at least two adjacent edges of each sign component piece are undercut by the bevelling thereof.

11. A changeable sign comprising: a support wall for changeable sign components, said support wall having on at least one side thereof an initially exposed sign component-receiving surface; said sign component-receiving surface having removably attached thereto a plurality of thin, flat, rectangular, flexible sign component pieces arranged in close edge-to-edge confronting relation and in contiguous rows so as to fill an entire sign-forming area of the sign and so that the sign component pieces from a distance appear to form a single sheet sign having one continuous flat surface; said sign component pieces being of two basic types, one type being indicia-containing sign component pieces having visible from the front faces thereof one or more numeric digits, symbols, and/or alphabet character indicia so as to form alone or with other adjacent sign component piece, numbers, words, and/or the like, and the other type including blank spacer component strips which fit between adjacent rows of indicia-containing sign component pieces, the sign component pieces in each row encompassing the same vertical height to present spaced, parallel horizontal edges to the top and bottom of each row, and each of said blank spacer strips presenting spaced, parallel horizontal edges at the top and bottom thereof extending at least a substantial proportion of the length of each row which edges confront the edges of the adjacent sign component pieces above and below the same.

12. The changeable sign of claim 11 wherein each of said sign component pieces except said strips have on the top and right side of the piece beveled edges of a given inclination and the bottom and left side of the piece having edges oppositely beveled to the edges of said top and right side so that adjacent confronting edges of adjacent component pieces above, below and to said side thereof interfit, and the top and bottom edges of said strips have the same beveled edges as the top and bottom edges of other sign component pieces.

13. The changeable sign of claim 11 wherein each of said sign component pieces comprises a thin flexible magnetic backing layer to which is adhesively secured a translucent cover layer having printed on the inner face thereof indicia visible from the front face of said cover layer.

14. The changeable sign of claim 11 wherein there are also narrow spacer component pieces between indicia-containing pieces in each row of the same.

15. The changeable sign of claim 11 wherein said indicia-containing sign component pieces include horizontally elongated row header strips heading the respective rows of indicia-containing sign component pieces and displaying complete words describing the type of information contained in the row of pieces involved, and there being in each row following each fow header strips relatively narrow sign component pieces each having thereon only a single numeral and which can be individually removed and replaced by another numeral sign component piece to modify the number displayed on the row of sign component pieces involved.

16. A changeable sign comprising: a support wall for changeable sign components, said support wall having on at least one side thereof an initially exposed sign component-receiving surface; said sign component-receiving surface having removably attached thereto a plurality of thin, flat, rectangular, flexible sign component pieces arranged in close contiguous rows so as to fill an entire sign-forming area of the sign and so that the sign component pieces from a distance appear to form a single sheet sign having one continuous flat surface, each sign component piece having a width less than that of a single row having on the top right side of the piece beveled edges of a given inclination and the bottom and left side of the piece having edges oppositely beveled to the edges of said top and right side so that adjacent confronting edges of adjacent component pieces above, below and to said side thereof interfit, and any sign component piece having the width of a single roay having top and bottom edges with the same beveled edges as the top and bottom edges of said sign component pieces, having a width less than the length of a row, whereby adjacent edges of the inner fitting sign component pieces hve complementary interfitting beveled edges.

* * * * *